United States Patent [19]

Ciani

[11] Patent Number: 4,934,447

[45] Date of Patent: Jun. 19, 1990

[54] DEVICE TO INTENSIFY THE MAGNETIC FIELD IN AN INGOT MOULD

[75] Inventor: Lorenzo Ciani, Udine, Italy

[73] Assignee: Danieli & C. Officine Meccaniche SpA and Ceda SpA Costruzioni Elettromeccaniche e Dispositivi d'Automazione, Buttrio, Italy

[21] Appl. No.: 271,433

[22] Filed: Nov. 15, 1988

[30] Foreign Application Priority Data

Nov. 24, 1987 [IT] Italy ..... 83496 A/87

[51] Int. Cl.[5] ..... B22D 27/02

[52] U.S. Cl. ..... 164/504; 164/468

[58] Field of Search ..... 164/468, 504, 466, 498, 164/499, 500, 502, 147.1

[56] References Cited

U.S. PATENT DOCUMENTS 2,398,018 4/1946 Linley ..... 164/498

4,026,346 5/1977 Birat ..... 164/504

FOREIGN PATENT DOCUMENTS 2315344 6/1975 France .

699156 10/1953 United Kingdom .

794424 5/1958 United Kingdom .

2079196 1/1982 United Kingdom .

*Primary Examiner*—Kuang Y. Lin

*Attorney, Agent, or Firm*—Wegner & Bretschneider

[57] ABSTRACT

Device to intensify the magnetic field in an ingot mould, the device cooperating with an ingot mould body (10) and with a means (11) which is positioned outside an outer jacket (14) of the ingot mould body (10) and generates a magnetic field, whereby independent, replaceable auxiliary extension pole pieces (18) stretching substantially towards a crystallizer (12) are comprised within outer jacket (14) of the mould body (10) in correlation with pole pieces (16).

6 Claims, 1 Drawing Sheet

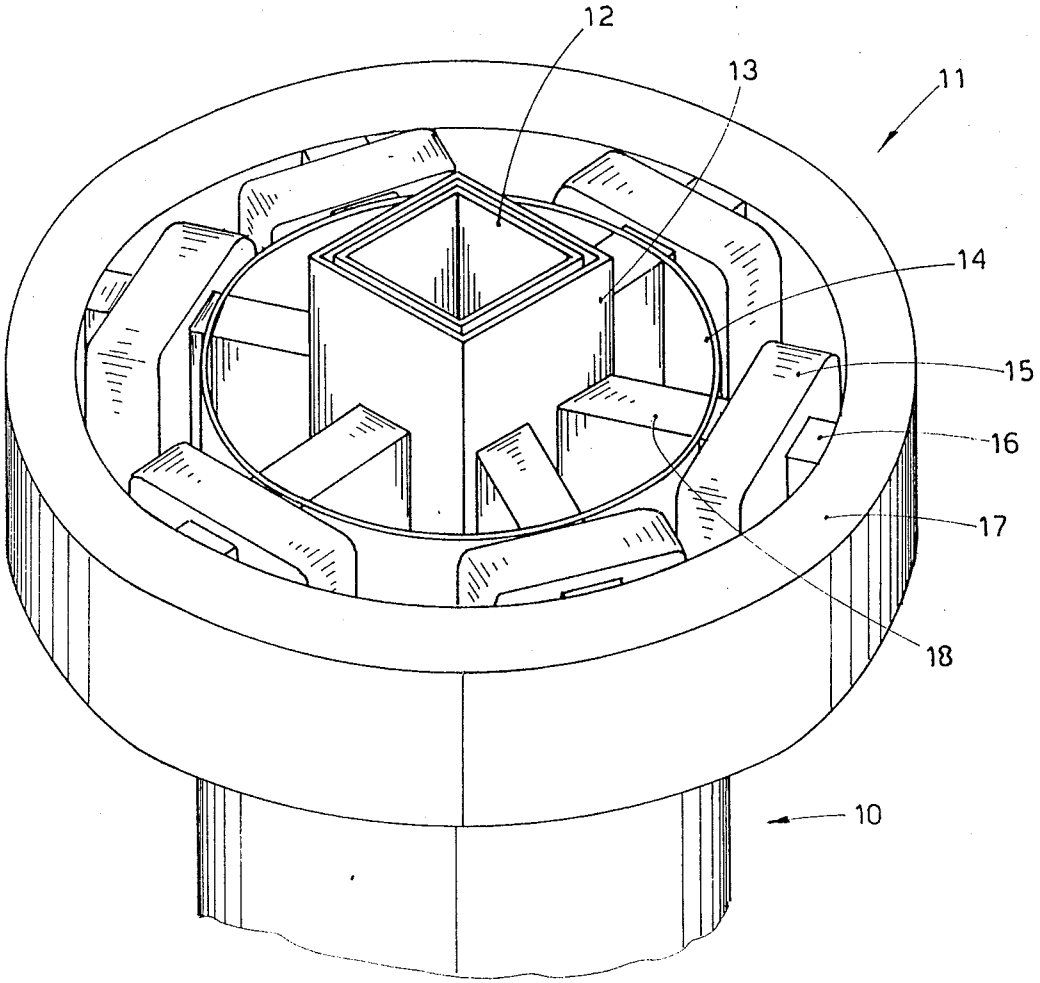
11
12
13
14
15
16
17
18
10

DEVICE TO INTENSIFY THE MAGNETIC FIELD IN AN INGOT MOULD

This invention concerns a device to intensify the magnetic field in a continuous casting ingot mould. To be more exact, the invention concerns a device suitable to intensify the action of the magnetic field generated by a means which generates an electromagnetic field and is located outside an ingot mould.

At the present time the means which generate an electromagnetic field are fitted either in the immediate vicinity of the crystallizer or outside the ingot mould itself.

Many advantages are obtained by fitting outside the ingot mould the means which generate the electromagnetic field. Among these advantages are the ability to replace the crystallizer easily and to vary its size and also the ability to carry out the replacement of the ingot mould too without having to take action on the means that generate the electromagnetic field or on the means or equipment connected to such generating means.

For these reasons many users and producers prefer to employ a means to generate the electromagnetic field which is located outside the ingot mould since the advantages accruing from such an embodiment are often greater than the drawbacks linked to a resulting attenuation of the magnetic field in the crystallizer.

The present applicant has therefore tackled the problem of obtaining a device suitable to intensify the magnetic field reaching the inside of the crystallizer without thereby changing the position of the means that generates the electromagnetic field, such means thus remaining outside the ingot mould.

According to the invention the means that generates the electromagnetic field remains the same as before and is not displaced from its position outside the ingot mould.

However, auxiliary extension pole pieces cooperating with the main pole pieces of the coils of the means that generates the electromagnetic field are provided within the ingot mould either as elements which can be inserted or as elements which can be connected to the cooling fluid conduit surrounding the crystallizer or else as elements which can be connected to the outer jacket of the ingot mould.

Such auxiliary extension pole pieces displace substantially the start of the massive dispersion of the magnetic field to the neighbourhood of the crystallizer and thus enable that field to be little attenuated at the time when it enters into cooperation with the crystallizer itself.

As we said above, the auxiliary extension pieces may be connected to the cooling fluid conduit or to the outer jacket or may pass through the cooling fluid conduit until they are in the immediate vicinity of the crystallizer, or else they may be inserted in appropriate supports provided between the conduit and the outer jacket.

In this way it becomes very easy to replace the crystallizer, possibly in conjunction with the replacement of the cooling fluid conduit and, when necessary, of the outer jacket too.

Such replacement may be fully prepared separately, so that the simple removal of old equipment and the fitting of new equipment take little less time and do not entail loss of output or an excessive waste of time.

The invention is therefore embodied with a device to intensify the magnetic field in a continuous casting ingot mould, whereby the means generating an electromagnetic field is located outside the ingot mould, the invention comprising the contents of the main claim and of one or another of the successive claims.

The attached FIGURE, which is given as a non-restrictive example, shows a three-dimensional view in which the upper part of an ingot mould has been cut away so as to show the cooperation of the invention with the mould itself.

In the FIGURE an ingot mould body 10 comprises a crystallizer 12 surrounded by a cooling fluid conduit 13 and externally by an outer jacket 14.

Fluid able to move at a high speed is fed between the conduit 13 and the crystallizer 12, while the outer jacket 14 performs the tasks of feeding, conveying and recovering the cooling fluid.

A means 11 which generates an electromagnetic field comprises a ferromagnetic core 17 cooperating with pole pieces 16, about which are positioned coils 15 that generate the electromagnetic field. The pole pieces 16 connect the ferromagnetic core 17 to the outer jacket 14 substantially.

The means that generates an electromagnetic field 11 is located outside the ingot mould 10 and the pole pieces 16 of that means 11 cooperate with the outer jacket 14 and, in particular, with the outer wall of the outer jacket 14; the pole pieces 16 may be supported on that outer wall 14 or may reach the neighbourhood of that outer wall 14.

According to the invention auxiliary extension pole pieces 18 are provided between the outer jacket 14 and the cooling fluid conduit 13 and are located in direct correlation with the pole pieces 16.

The auxiliary extension pole pieces 18 may be supported substantially on the cooling fluid conduit 13 or may surmount that conduit 13 and reach the immediate neighbourhood of the crystallizer 12.

The auxiliary extension pole pieces 18 may be rested on the inner wall of the outer jacket 14 and on the outer wall of the fluid conduit 13 respectively. They may also be supported on one or the other of those walls.

According to a variant the auxiliary extension pieces 18 are connected firmly either to the conduit 13 or to the outer jacket 14 or to both 13–14.

According to a further variant the auxiliary extension pole pieces 18 are inserted in appropriate seatings included in the wall of the cooling fluid conduit 13 or in the outer jacket 14, so that they can be inserted, removed and replaced very easily.

According to another variant the auxiliary extension pole pieces 18 pass through the wall of the conduit 13 and reach the neighbourhood of the crystallizer 12.

In the embodiment according to the invention the replacement of the crystallizer 12, or of the crystallizer 12 and conduit 13, or else of the whole ingot mould 10 will not entail any difficulty and can be carried out in a very short time without thereby causing any waste of time, working problems or even a waste of energy.

I claim:

1. A continuous casting ingot mold, comprising an outer jacket conduit, a cooling fluid conduit passing concentrically through said outer jacket conduit, a crystallizer passing concentrically through said cooling fluid conduit, and a magnetic stirring device; said crystallizer conveying molten metal, cooling fluid being fed between said crystallizer and said cooling fluid conduit, and cooling fluid also passing between said cooling fluid conduit and said outer jacket conduit; said magnetic stirring device comprising:

a magnetic core disposed around and outside of said outer jacket conduit;

a plurality of pole pieces magnetically cooperating with said magnetic core and radially extending between said magnetic core and an outer surface of said outer jacket conduit; and at least one electromagnetic coil, disposed between said magnetic core and said outer jacket conduit, magnetically cooperating with at least one of said plurality of pole pieces for generating a magnetic field within said crystallizer.

2. A continuous casting ingot mold as claimed in claim 1, further comprising a plurality of extension pole pieces, each of said extension pole pieces magnetically cooperating with one of said plurality of pole pieces and radially extending from an inner surface of said outer jacket conduit substantially toward said crystallizer.

3. A continuous casting ingot mold as claimed in claim 2, wherein each of said plurality of extension pole pieces extend from an inner surface of said outer jacket conduit to an outer wall of said cooling fluid conduit.

4. A continuous casting ingot mold as claimed in claim 2, wherein each of said plurality of extension pole pieces extend from an inner surface of said outer jacket conduit, through said cooling fluid conduit, to an outer wall of said crystallizer.

5. A continuous casting ingot mold as claimed in claim 2, wherein each of said plurality of extension pole pieces is supported by an inner wall of said outer jacket conduit.

6. A continuous casting ingot mold as claimed in claim 3, wherein each of said plurality of extension pole pieces is supported by said cooling fluid conduit.

* * * * *